United States Patent [19]

Custer et al.

[11] 4,098,670

[45] Jul. 4, 1978

[54] SEALING MEMBER FOR AN ELECTROLYTIC CELL

[75] Inventors: Harry S. Custer, Barberton; Brian H. Oliver, Akron, both of Ohio

[73] Assignee: The Goodyear Tire & Rubber Company, Akron, Ohio

[21] Appl. No.: 563,000

[22] Filed: Mar. 27, 1975

[51] Int. Cl.[2] ..... C25B 1/16; C25B 1/26; C25B 9/00

[52] U.S. Cl. ..... 204/252; 204/242; 204/266; 204/279; 260/3.3; 260/5

[58] Field of Search ..... 204/252, 242, 266, 279, 204/278; 260/4 R, 5, 3.3, 886

[56] References Cited

U.S. PATENT DOCUMENTS

| | | | |
|---|---|---|---|
| 2,482,600 | 9/1949 | Sarbach | 260/5 X |
| 3,331,793 | 7/1967 | Souffie | 260/4 |
| 3,563,878 | 2/1971 | Grotheer | 204/256 |
| 3,796,648 | 3/1974 | Conner, Jr. et al. | 204/252 X |
| 3,857,775 | 12/1974 | Custer et al. | 204/252 |
| 3,925,185 | 12/1975 | Lint | 204/252 |

*Primary Examiner*—Arthur C. Prescott
*Attorney, Agent, or Firm*—R. P. Yaist

[57] ABSTRACT

A heat and chemically resistant sealing member particularly for an electrolytic cell of the diaphragm type in which the cell includes a cell can for containing a brine solution, a rigid cell base for supporting the can and anode members disposed within the can. The sealing member comprised of at least one vulcanized rubbery polymer provides a compressive seal between rigid members of the cell and is subjected to the heat within the cell. After long periods of exposure to this heat the sealing member is of a relatively flexible, resilient rubbery nature and has a relatively high resistance to compression set to thereby retain its sealing properties. The sealing member is preferably a flexible elastomeric sheet particularly useful for providing a seal and cover for the conductive base of the cell.

18 Claims, 3 Drawing Figures

SEALING MEMBER FOR AN ELECTROLYTIC CELL

BACKGROUND OF THE INVENTION

This invention relates to a flexible non-conductive sealing member used in an electrolytic cell particularly of the diaphragm type for the electrolysis of brines. More specifically this invention relates to a flexible vulcanized sheet to provide a seal and cover for the base of such an electrolytic cell. This invention even more specifically relates to such a sheet having improved sealing properties.

Diaphragm-type cells conventionally have included an outer steel shell or can either of a cylindrical or rectangular configuration which supports a foraminous or perforated metallic cathode constituting the cathode assembly. A fluid permeable diaphragm overlays the cathode to permit the brine solution contained in the anode compartment to flow or percolate through the diaphragm and cathode into the cathode chamber. The diaphragms and cathodes are usually arranged vertically but may also be disposed horizontally. The anodes conventionally take the form of flat vertically disposed blades of graphite which have been inserted into slots formed by a plurality of conductive copper metal grids which are mounted on the cell base. The grid members and the anodes are electrically connected to each other and are usually secured through the base by an electrically conductive bonding layer of lead. An electrically insulating layer or coating of a material such as asphalt is then applied over the electrically conductive bonding layer and a layer of concrete is finally applied over the asphalt layer to complete the base construction. A detailed description of an electrolytic cell of the type described is given in U.S. Pat. No. 2,987,463 issued on June 6, 1971, to J. C. Baker et al. In addition, a complete discussion of the construction and operation of a diaphragm type cell can be found in the *Encyclopedia of Chemical Technology,* Second Edition, Vol. 1 (1963) on Pages 681–687.

Recently the conventional graphite anodes have been replaced by the development of dimensionally stable anodes. Consequently, it has become necessary to provide diaphragm-type electrolytic cells having a cell base of a more simple construction suitable for use with dimensionally stable anodes. U.S. Pat. No. 3,591,483 issued July 6, 1971, to R. E. Loftfield et al discloses a diaphragm-type electrolytic cell having improved cell base constructions in which a single sheet of at least one electrically non-conductive material such as neoprene rubber covers the entire cell base and serves to provide a compressible seal between the anodes and the cell base and between the cell base and the brine solution contained in the cell can. The sheet and the cell base are provided with aligned holes for the receipt of anode risers which extend through these holes in the non-conductive sheet and the cell base and are fastened on the bottom of the cell base by suitable means such as a nut. Each riser is provided with a flange or collar which upon tightening of the nut, forms a hydraulic seal with the non-conductive sheet, thereby preventing leakage of the brine solution or solution of electrolyte onto the cell base. It has also been the practice in at least some instances for added protection against the effects of the brine solution to use a corrosion resistant grease-like sealing material between the neoprene rubber sheet and the area of the cell base disposed beneath the collar and between the neoprene rubber sheet and the area around and under the collar.

Although neoprene rubber has proven to be a suitable material for providing a seal and cover for the conductive base for limited periods of time, it has not been completely satisfactory over long periods of time. Often the elastomeric sheet has become hard and brittle due to the relatively high temperatures to which the sheet is subjected. These temperatures range from about 180° to 190° F (82° to 88° C) on the face of the sheet in contact with the brine or electrolyte solution and from about 180° to 250° F (82° to 121° C) on the opposite face of the sheet which is in contact with the conductive copper or aluminum base of the cell.

Because of this, a flexible sheet comprised of a vulcanized blend of heat resistant polymers has been developed for improved resistance to heat over long periods of time. This sheet is disclosed in our application Ser. No. 371,323 issued as U.S. Pat. No. 3,857,775 on Dec. 31, 1974.

It is also well known that the diaphragm chlorine cell units fluctuate in temperature from a normal operating temperature of approximately 180° F (82° C) which may reach as high as 250° F (121° C) on the base plate, to ambient and back to operating temperature again. Due to this change or fluctuation in temperature it has been discovered that the seal between the anode riser and the rubber sheet or gasket may be broken which results in the seepage of the brine solution onto the conductive base of the cell and causes its rapid corrosion and deterioration. It is well recognized in this regard that even a minute amount of brine which is allowed to leak through the broken seal onto the copper or aluminum cell base will continue to corrode the metal part to ultimate failure even though the rubber gasket has become resealed as a result of a further temperature change. Consequently, in order for the sheet to perform satisfactorily for the life of the cell it is imperative that the seal be maintained at all times regardless of temperature change or other occurances during the life of the cell.

Accordingly, although it is, of course, important that the diaphragm sheet be formulated for heat resistance and chemical resistance, it is believed that sealability of the sheet will be optimized if the polymeric material of the sheet is compounded for optimum resistance to compression set as well. The sheet after long periods of exposure to heat therefore should have a relatively flexible, resilient, rubbery nature and also exhibit a low initial compression set with a retention of a relatively low set. In this way, it is anticipated that the low compression set characteristics (high resistance to compression set) will compensate for the changes in temperature and the compression seal between the outer upwardly facing surface of the sheet and the flange of the anode riser can be maintained continuously for the life of the sheet.

Other type sealing members in addition to the flat sheet may also be used in an electrolytic cell to provide a compressive seal between rigid members of the cell and are subject to these same conditions and resulting problems.

OBJECTS OF THE INVENTION

It is therefore a primary object of the present invention to provide an improved sealing member for use between rigid members of an electrolytic cell with the sealing member providing a satisfactory seal over wide temperature variations.

It is another primary object of the present invention to provide an improved non-conductive sheet for use as a seal and cover in an electrolytic cell of the type described with the sheet being comprised of at least one vulcanized rubbery polymer which after long periods of exposure to heat remains of a relatively flexible, resilient, rubbery nature and which exhibits a relatively high resistance to compressive set to thereby retain its sealing properties.

It is another important object of the present invention to provide a heat resistant and chemically resistant polymeric sheet which has relatively low compression set properties and which will retain a relatively high resistance to compression set after long periods of use as a seal and cover for the cell base of an electrolytic cell of the diaphragm type.

It is still another object of the present invention to provide an elastomeric sheet of improved sealability for use in an electrolytic cell of the diaphragm type employing dimensionally stable anodes.

Other objects and advantages of this invention will become apparent hereinafter as the description thereof proceeds, the novel features, arrangements and combinations being clearly pointed out in the specification as well as the claims thereunto appended.

In accordance with the present invention, it has been found that the above objects are accomplished in an electrolytic cell for the electrolysis of brine which includes a cell can for containing a brine solution, a rigid cell base supporting the can and anode members disposed within the can by providing a flexible heat and chemically resistant sealing member comprised of at least one vulcanized rubbery polymer. The sealing member provides a compressible seal between rigid members of the cell and is subjected to the heat within the cell. After long periods of exposure to this heat the sealing member is of a relatively flexible, resilient, rubbery nature and has a relatively high resistance to compression set to thereby retain its sealing properties.

In a preferred form of the invention the rigid base is comprised of conductive metal with the anode members extending through the base and the sealing member is a vulcanized rubbery sheet covering substantially the entire cell base and in compressible engagement with the anode members. The sheet provides a compressible seal between the anode members and the cell base and between the cell base and the brine solution contained in the can with the sheet subjected to the heat generated by the brine solution and by the conductive metal of the base.

Preferably the sealing member or sheet when heat treated at 250° F (121° C) for the following periods of time and tested in accordance with ASTM D-395, Method B, will exhibit a compression set of less than about or no more than the following values.

| Heat Treatment (Time) | Compression Set (%) |
|---|---|
| 70 hours | 35 |
| 7 days | 50 |
| 14 days | 65 |
| 28 days | 80 |

More preferably, under these same conditions for the following periods of time the sheet will exhibit a compression set of less than about or no more than the following values:

| Heat, Treatment (Time) | Compression Set (%) |
|---|---|
| 70 hours | 25 |
| 7 days | 35 |
| 14 days | 45 |
| 28 days | 60 |

It is also preferred that the sheet when a ¼ inch (6.35 mm) thick test specimen thereof is compressed 25 percent of its original thickness and heat treated at 250° F (121° C) for 60 days will remain free of cracks. It is even more preferred that the sheet remain free of cracks for 90 days when tested under the same conditions.

It is preferred that the sealing member be comprised of at least one polymer selected from the group consisting of ethylene propylene terpolymer rubber, ethylene propylene rubber, halogenated butyl rubber, cross-linked butyl rubber, chlorinated polyethylene and ethylene-vinyl acetate copolymer rubber. It is also preferred that the polymer has been vulcanized using a vulanizing agent selected from the group consisting of the peroxide type and the sulfur donor type with the peroxide type vulcanizing agents being preferred. It will be understood that the particular type of vulcanizing system selected will depend upon the type of polymer to be vulcanized.

It is also to be understood that for the purposes of this invention, the term "vulcanized" is used in its broadest sense to include all known means of cross-linking rubbery polymers.

DESCRIPTION OF THE PREFERRED EMBODIMENTS

Figure 1:
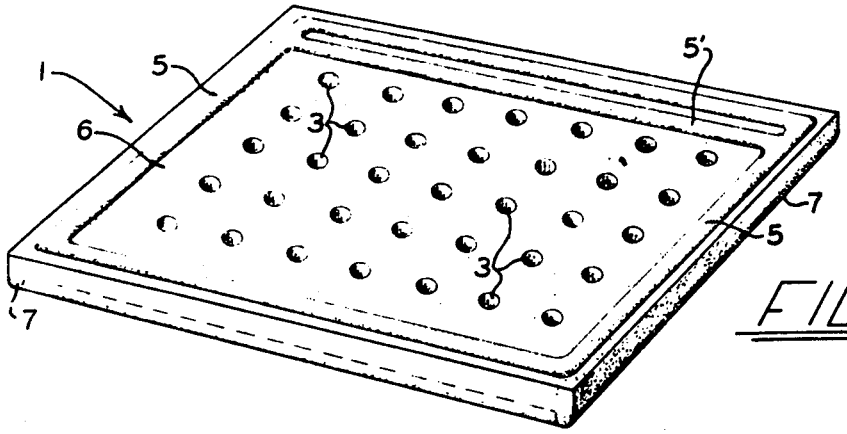
FIG. 1 is a perspective view of the flexible vulcanized sheet of this invention prior to its installation in an electrolytic cell of the diaphragm type.
Figure 2:
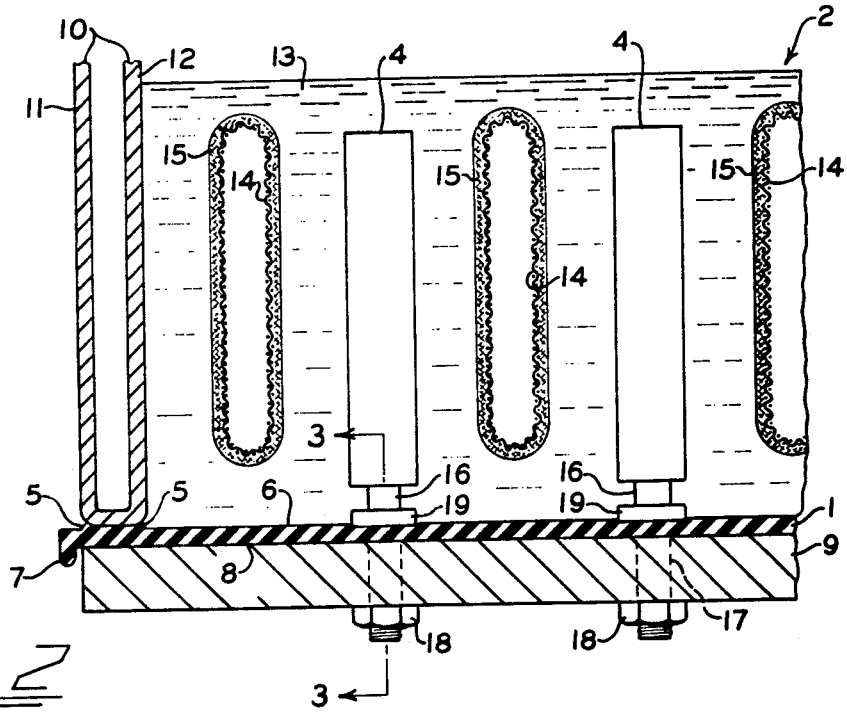
FIG. 2 is a partial side elevational view of a portion of an electrolytic cell of the diaphragm type taken along its length with parts broken away to show a section through the flexible vulcanized sheet in its installed position in the cell.

In FIG. 1 the sealing member of the present invention in the form of a flexible vulcanized heat and chemically resistant sheet or blanket 1 is shown in its uninstalled condition. In this instance, the sheet 1 has a generally rectangular configuration and is comprised of one or more layers of vulcanized elastomeric or polymeric material. The sheet 1, when installed in a diaphragm type cell 2, is shown in FIG. 2. The sheet 1 includes a plurality of circular uniformly positioned holes 3 which have been punched or cut out of the sheet after vulcanization or which alternately may be formed during a molding or vulcanizing process. The anode members 4 of the cell 2 shown in FIG. 2 will be inserted through these holes 3 as will be hereinafter described. The exact number and specific location of each hole, of course, will depend upon the particular construction of the cell in which the sheet is installed. The holes, for example, may have a diameter of about 1.25 inches (31.75 mm).

The sheet 1 preferably includes a strip 5 of elastomeric material disposed on its upper or brine side surface 6 which extends around the outer periphery of the sheet 1. The strip 5 is, for example, of a semicircular cross-sectional configuration to provide a half round O-ring seal. The strip 5 may be an extrusion of either the same or a different elastomeric material as the sheet 1 which is adhered to the sheet by means of a suitable adhesive or may be molded as an integral part of the sheet if desired. In addition, another similar strip 7 of elastomeric material preferably is also provided at the lateral edges around three sides of the periphery of the lower or base side surface 8 of the sheet 1 extending over and protecting the peripheral edges of the cell base 9 on these three sides. The strip 7 ordinarily must be omitted on the lower surface of the side of the cell base 9 (not visible in the drawings) which is connected to a source of electrical power since the base plate 9 ordinarily extends beyond the edge of the sheet 1 at this location and is not covered thereby. Hence, no protective strip 7 is necessary. The strip 7 may be provided in the same manner as the sealing strip 5. An additional strip 5' of elastomeric material may be provided on the surface 6 of the sheet 1 for added sealing protection on the side of the sheet that does not include the strip 7.

As shown in FIG. 2, the cell 2 is, for example, of a construction disclosed in U.S. Pat. No. 2,987,463 and only the principle parts of the cell necessary for an understanding of the present invention will be discussed herein. The cell includes an outer shell or cell can 10 constructed of two spaced metal plates 11 and 12. The cell can 10 contains a brine 13 or electrolyte solution. The cell can 10 rests on the strip 5 which serves as a gasket to seal the inner periphery of the can. A small amount of a soft sealing material such as chemically inert putty (not shown) is normally provided adjacent to the inside of the strip 5 to insure the integrity of the seal. Cathodes 14 in the form of parallel hollow fingers constructed of perforated metal plate or metal screen project horizontally from opposite sides of the cell can 10 and are electrically joined thereto by means of welds on at least one side of the cell can (not shown). Fluid permeable diaphragms 15 of asbestos material or the like overlay or are deposited upon the cathodes 14. The cathodes 14 alternate with anode members 4 which are flat vertically disposed blades of dimensionally stable material such as platinum group metals and alloys of platinum group metals. A more complete list of acceptable dimensionally stable material may be found in U.S. Pat. No. 3,591,483 in Columns 4 and 5.

The anode members as shown in FIG. 2 include anode risers 16 welded to the anode 4 and composed of similar dimensionally stable material. The anode risers 16 are inserted through the holes 3 in the sheet 1 and extend through the cell base 9 which is constructed of an electrically conductive material such as copper or aluminum plate provided with holes 17 that are aligned with the holes 3 of the sheet 1 to receive the anode risers. A power supply (not shown) is attached directly to the cell base 9. The anode risers 16 extend beneath the base plate and are fastened on the bottom of the cell base 9 by means of a nut 18. The anode riser 16 includes a flange or collar 19 which contacts the outer surface of the sheet 1. The anode riser 16 typically has a diameter of about 1.25 inches (31.75 mm) and the combined diameter of the flange 19 and riser 16 is about 2 inches (50.81 mm).

The sheet or blanket 1 covers substantially the entire surface of the cell base 9 with the strip 7 serving as a protective lip to prevent brine or water from getting between the sheet 1 and the cell base 9.

Figure 3:
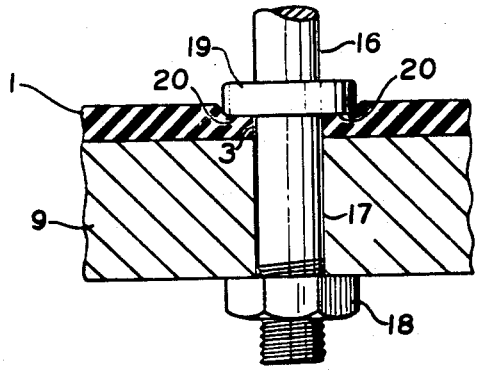
FIG. 3 is an enlarged sectional view taken on line 3—3 of FIG. 2.

During the operation of the cell, the sheet is subjected to severe conditions of stress and temperature. As shown in FIG. 3, the portion 20 of the sheet in contact with the collar 19 of the anode riser 16 is compressed as much as 25 percent upon tightening of the nut 18. For example, a sheet having a thickness of about ¼ of an inch (6.35 mm) may be compressed to a thickness of about 3/16 of an inch (4.76 mm) resulting in the creation of stress areas around the hole 3. The upwardly disposed surface 6 of the sheet 1 is in direct contact with the brine solution 13 contained in the cell can 10 which is of a temperature of from about 180° to about 190° F (82° to 88° C). Moreover, the temperature of the power receiving cell base 9 which contacts the downwardly disposed surface 8 of the sheet 1 has been measured at from 180° to 250° F (82° to 121° C). It is considered that the sheet 1 is subjected to temperatures ranging from ambient to a temperature of about 200° F (93° C) during the operation of the cell 2. Furthermore, the brine solution 13 contains corrosive substances such as chlorine which will attack the elastomeric material of the sheet 1. Previously, sheets comprised of elastomeric material such as conventionally compounded rubber have failed prematurely in service due to these changes or fluctuations in temperature. This occurred since the seal in the area of the anode receiving hole 3 at the juncture of the anode riser collar 19 and the portion 20 of the face or surface 8 of the sheet disposed under the collar 19 became broken and thus inoperative. This condition resulted in the seepage of brine through the non-conductive sheet onto the conductive cell base causing corrosion and hot spots to develop in the cell base material resulting in the cell being removed from service.

In accordance with this invention, the sheet 1 is formulated for heat and chemical resistance and also for suitable compression set properties. To this end the sheet is comprised of a vulcanized rubbery polymer which is compounded to remain of a relatively flexible, resilient, rubbery nature and to have a relatively high resistance to compression set even after long periods of exposure to heat to thereby insure retention of a compression seal with the anode member. Preferably, the sheet when heat treated for 70 hours at 250° F (121° C) in accordance with ASTM D-395, Method B, will exhibit a compression set of less than about or no more than 35 percent and even more preferably a compression set of less than about or no more than 25 percent. The sheet must also exhibit relatively low compression set levels after long periods of exposure to heat under these same test conditions. For example, after 7 days the compression set is less than or no greater than about 50 percent and preferably less than or no greater than about 35 percent. After 14 days these levels are 65 percent and preferably 45 percent and after 28 days 80 percent and preferably 60 percent.

It is even more preferred that the sheet exhibit the necessary properties when tested under more severe conditions than those prescribed in ASTM D-395, Method B. These more demanding tests can either be variations of the ASTM approach or be other recognized procedures. For example, when a ¼ inch thick (6.35 mm) test specimen of the sheet is compressed 25 percent of its original thickness and heat treated at 250° F (121° C) for 70 hours it will exhibit a compression set of less than about or no more than 50 percent and preferably less than or no more than 30 percent. Under these same conditions the compression set will be less than about or no greater than 60 percent and preferably 45 percent, after 7 days, 75 percent and preferably 55 percent after 14 days and will be less than about or no greater than 85 percent and preferably 75 percent after 28 days. These tests specimens should also show no surface cracks or other similar defects after exposure at 250° F (121° C) for 60 days and more preferably after exposure for 90 days.

Preferably the sheet is comprised of a heat and chemically resistant polymer such as ethylene propylene terpolymer rubber, ethylene propylene rubber, halogenated butyl rubber, cross-linked butyl rubber, chlorinated polyethylene or ethylene-vinyl acetate copolymer rubber. All of these polymers are compounded to remain relatively flexible, resilient and rubbery in nature after long periods of exposure to heat. In addition they are compounded to attain a low compression set or a relatively high resistance to compression set and to retain a relatively low set after long periods of exposure to heat. For this purpose it is preferred that the polymers be vulcanized using a vulcanizing agent known to achieve the lowest possible set properties in accordance with accepted compounding techniques. Vulcanizing agents of the peroxide and sulfur donor type are preferred with the particular vulcanizing agents being selected for their effectiveness with the particular polymer.

In the practice of the invention, the polymers which are vulcanized using a peroxide type vulcanizing agent are ethylene propylene terpolymer rubber, ethylene propylene rubber, halogenated butyl rubber, cross-linked butyl rubber, chlorinated polyethylene and ethylene-vinyl acetate copolymer or blends of these polymers. Those which are vulcanized using a vulcanizing agent of the sulfur donor type are ethylene propylene terpolymer rubber and halogenated butyl rubber. It has been determined that the most satisfactory results are achieved by using a vulcanizing agent of the peroxide type.

The ethylene propylene terpolymers which may be used in accordance with the present invention are terpolymers of ethylene, propylene and non-conjugated dienes (EPDM). Representative examples of these rubbery terpolymers are described in U.S. Pat. No. 3,331,793, Column 2, lines 54–59.

The ethylene propylene polymers useful in the practice of the present invention consist essentially of linear homogeneous copolymers of propylene and ethylene as particularly described in U.S. Pat. No. 3,300,459.

In accordance with the invention, another heat and chemically resistant polymer which may be compounded to have the desired compression set properties is at least one halogenated butyl rubber polymer such as chlorinated butyl and brominated butyl rubber. The halogenated butyl rubbers or halobutyl rubbers as they are sometimes called are well known in the art being prepared normally by the halogenation of butyl rubber, a well known polymer containing a major portion of bound isobutylene, e.g. from about 85 to 99.5 weight percent, and a minor portion of isoprene, e.g. from about 15 to 0.5 weight percent. Halobutyl rubbers include chlorobutyl as well as bromobutyl rubber. Descriptions of halobutyl rubber and its preparation appear in U.S. Pat. No. 3,242,148, the revelations of which are incorporated herein by reference. In chlorobutyl rubber typically the chlorine content is less than 3 percent by weight normally being from about 1.1 to about 1.3 weight percent. Normally about 75 percent of the unsaturation in the original butyl rubber is retained on chlorination, the unsaturation usually being from about 1.1 to about 1.7 percent. A typical molecular structure of Enjay Butyl HT Polymer is shown as follows:

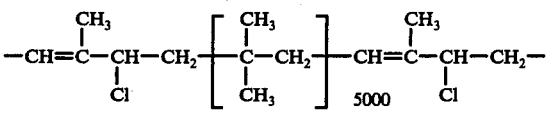

The compounding and vulcanization of chlorobutyl rubber is well known; see U.S. Pat. No. 3,197,446, the disclosures of which are incorporated herein by reference. Bromobutyl rubber is similar to chlorobutyl rubber, the main difference being that it contains bromo groups rather than chloro groups. Butyl rubbers containing both chloro and bromo groups can also be used.

Halogenated butyl rubbers are also described in the *Encyclopedia of Chemical Technology,* Second Supplement Volume, edited by Raymond E Kirk and Donald F Othmer, The Interscience Encyclopedia, Inc., New York, pages 716 to 734, and the *Encyclopedia of Polymer Science and Technology,* Vol. 2, Interscience Publishers, a division of John Wiley & Sons, Inc., New York, London, Sidney, pages 762, 763, 771, 772 and 782. The revelations of these references are incorporated herein by reference.

Cross-linked butyl rubber is a terpolymer of an isoolefin, an aliphatic diene and an aromatic divinyl monomer produced commercially by ionic polymerization. A preferred terpolymer is a terpolymer of isobutylene, isoprene and divinyl benzene. Preferably the polymers are prepared by copolymerizing a monomer system comprising 80 to 99.8 parts by weight of an isoolefin of 4 to 7 carbon atoms, 0 to 19.8 parts by weight of an aliphatic diene of from 4 to 14 carbon atoms and from 0.2 to 5 parts by weight of an aromatic divinyl compound, all parts being per 100 parts by weight of total monomer. Cross-linked butyl rubber is more fully described in Canadian Pat. No. 817,939 the teachings of which are incorporated by reference herein.

Chlorinated polyethylene elastomers may be manufactured by various methods such as solution, dry and aqueous slurry chlorination but commercially available chlorinated polyethylene is exclusively produced by the latter method. The chlorinated polyethylene polymer useful in the present invention are derived from an agueous slurry, free-radical chlorination of Ziegler process high density polyethylene (HDPE). The resulting rubbers are free flowing powders generally having a particle size range of 300 to 500 microns and possess molecular weights between 100,00 and 1,000,000, chlorine contents of 25 to 50 percent by weight and are amorphorus in nature. Chlorinated polyethylene is fully described in U.S. Pat. Nos. 3,454,544, 3,429,865 and 3,563,974 the teachings of which are incorporated by reference herein.

The ethylene-vinyl acetate (E/VA) copolymer rubbers of the present invention are a vulcanized rubbery copolymer of ethylene and vinyl acetate. The polymers are completely non-crystalline and in the rubbery state in the range of 50 to 80 percent vinyl acetate. For the purposes of this invention it is preferred that the vinyl acetate monomer be present in an amount of from about 45 percent to about 60 percent and more preferably in an amount of from about 45 percent to 55 percent by weight vinyl acetate. Ethylene-vinyl acetate polymers of all compositions are prepared essentially by batch or continuous "mass" polymerization of the monomers at ultra high pressures with peroxide or other free-radical-generating-initiators. Ethylene-vinyl acetate polymers are more fully described in *Rubber Age,* "Ethylene/Vinyl Acetate" by I O Salyer and H M Leeper, June, July 1971.

The peroxide type vulcanizing agents useful in the practice of the present invention include organic peroxides such as dicumyl peroxide, 2,5di-(tertiary-butylperoxy)-2,5 dimethyl hexane, di-tertiarybutylperoxide, 2,5-di-(tertiarybutylperoxy)-2,5-dimethylhexyne-3, and bis (tertiary-butylperoxy isopropyl) benzene.

Representative examples of the sulfur donor type vulcanizing agents which may be used in the practice of the present invention are tetramethyl thiuram disulfide, tetraethyl thiuram disulfide, 4,4'-dithiodimorpholine and 4-morpholino-2 benzothiazole disulfide. Accelerators which are commonly used in sulfur donor systems of this type are 2-mercaptobenzothiazole, benzothiazole disulfide, diphenyl guanidine, zinc dimethyl dithiocarbamate, zinc dibutyldithiocarbamate, and copper dimethyldithiocarbamate.

In the sulfur donor type vulcanization systems activators well known in the art such as zinc oxide, magnesium oxide and stearic acid should also be used to enhance the cure.

It is to be understood that it may be necessary, in addition to the vulcanizing agents named, to use certain coagents well known in the art of rubber compounding in order to enhance the cure and establish the desired compressive set levels. For example, when vulcanizing halogenated butyl rubber using a peroxide type vulcanizing agent it is desirable to use polyfunctional monomers and polymers to enhance and promote vulcanization. These may include, for example, triallyl cyanurate, triallyl isocyanurate, hydroxy polybutadiene or metaphenylene-bis-maleimide.

Various additives, fillers, plasticizers and pigments can also be added to the polymers of the present invention. Examples of such material are: carbon blacks, particularly of the fast extruding furnace and high abrasion furnace types, non-black fillers such as silica and plasticizers such as petroleum oils, naturally occurring and synthetic ester oils, and resinous polymers of the naturally occurring and synthetic types.

The method of making the sealing member such as the flexible vulcanized sheet 1 of the present invention to be used in an electrolytic cell of the diaphragm type for the electrolysis of brine includes compounding a heat-resistant formulation by using the polymers discussed above or various blends or combinations thereof to form a heat-resistant rubbery vulcanized composition. This can be accomplished by conventional mixing techniques using conventional rubber processing equipment such as a Banbury mixer or mixing mill. Equivalent results are obtained with internal Banbury mixed formulations and mill mixed formulations. Curatives may be added during either a first or a second pass in the Banbury mixer or separately on a mixing mill. The rubbery composition is then formed into a vulcanized sheet in a conventional manner, for example, by using a rubber calender or extruder to form the sheet into the desired dimensions and by thereafter vulcanizing or curing the formed sheet by means of a curing press, rotocure, autoclave or hot air oven. After vulcanization, the anode receiving holes 3 and the elastomeric strips 5, 5' and 6 are provided in a manner as previously described.

The following examples further illustrate the objects and advantages of this invention.

EXAMPLE 1

Two flexible vulcanized elastomeric sheets 1 of the type shown in FIGS. 1–3 were manufactured having the following Compositions A and B:

| Components | Parts by Weight A | Parts by Weight B |
|---|---|---|
| Ethylene propylene terpolymer (1) | 100.00 | — |
| Ethylene propylene terpolymer (2) | — | 100.00 |
| Carbon black | 90.00 | 90.00 |
| Plasticizer | 50.00 | 50.00 |
| Zinc oxide | 5.00 | 5.00 |
| Stearic acid | 1.00 | — |
| Zinc stearate | — | 1.00 |
| Antioxidant | 2.00 | 2.00 |
| Sulfur | 0.10 | — |
| 4,4' dithiodimorpholine (3) | 1.50 | — |
| Zinc dibutyldithiocarbamate (4) | 4.00 | — |
| Mixture of tetramethyl and tetraethyl thiuram disulfide (5) | 2.50 | — |
| Bis(tertiary-butylperoxy isopropyl) benzene (6) | — | 6.00 |
| | 256.60 | 253.00 |

(1)Nordel 1470 obtained from E I duPont deNemours & Company
(2)Nordel 1070 obtained from E I duPont deNemours & Company
(3)Sulfasan R obtained from R T Vanderbilt, Inc.
(4)Butyl Zimate obtained from R T Vanderbilt, Inc.
(5)Methyl, Ethyl Tuads obtained from R T Vanderbilt, Inc.
(6)Vulcup R obtained from Hercules, Inc.

In the above compositions the plasticizer used was paraffinic oil and the carbon black used was the fast extruding furnace type. The vulcanizing agents used in Composition A were of the sulfur donor type and in Composition B were of the peroxide type.

The above formulas are expressed in proportions on the basis of parts by weight based on the weight of the ethylene propylene terpolymer rubber.

The above compositions were prepared in the following manner. All the compounding ingredients except the vulcanizing agents were added to a Banbury mixer and mixed to produce a non-productive stock. The vulcanizing agents were then added to the non-productive stock in the Banbury during a second pass mixing procedure.

The above compositions were then processed on a roller die extruder and each was formed into a rectangular sheet or web of material having a gauge or thickness of ¼ of an inch (6.35 mm). Each sheet was next rolled into a polyethylene liner. Each roll thus formed was cured in a rotocure at a temperature of 360° F for 18 minutes. After vulcanization, each sheet 1 is prepared for installation in an electrolytic cell 2 of the type shown in FIG. 2 by being cut and trimmed to size. Each sheet has, for example, a width of 45 inches (1143 mm), a length of 69$\mu$ inches (1771.7 mm) and a gauge of ¼ of an inch (6.35 mm). Holes 3 for receiving the anode risers 16 are punched in this sheet with the holes 3 being disposed, for example, in equally spaced rows with an equal number of holes in each row. The holes 3, for example, may have a diameter of about 1.25 inches (31.75 mm). Each sheet is then provided with extruded strips 5, 5' and 6 of neoprene rubber adhered to the sheet in the locations shown in FIG. 1 by means of a commercially available adhesive. In this regard, however, it should be appreciated that the strip may also be of the same composition as the sheet 1 indicated above with other suitable adhesives being used.

Each sheet is then installed in an electrolytic cell 2 as shown in FIG. 2 of the type described in U.S. Pat. No. 2,987,463 (Hooker type S-3) except having a cell base construction as described in U.S. Pat. No. 3,591,483. The installation includes placing the sheet 1 on a copper base plate 9 so that the holes 3 in the sheet 1 are aligned with an equal number of holes 17 in the base 9. Then dimensionally stable anodes 4 are set in place with anode risers 16 having a diameter of about 1.25 of an inch (31.75 mm) being inserted through the anode-receiving holes 3 of the sheet 1. The anode risers 16 are bolted to the bottom side of the copper base plate 9 and the collar or flange 19 of the riser 16 is seated against the upwardly disposed surface 6 of the sheet 1 with the combined diameter of the flange 19 and riser 16 being about 2 inches (50.80 mm). The nut 18 at the bottom of the cell base 9 is tightened so that the sheet 1 is compressed from a diameter of about ¼ of an inch (6.35 mm) to a diameter of about 3/16 of an inch (4.76 mm). After the installation of the cell base 9, the cell can 10, cathodes 14 and diaphragms 15 are fitted in place to complete the assembly of the cell 2.

The cell 2 is then fed with a brine solution 13 and operated under general conditions of the type described in the example provided in U.S. Pat. No. 3,591,483, Column 8. After several months of service the sheets have shown no visible signs of heat cracking and the compression seal between the flange 19 and the surface 6 of each sheet 1 has been adequately maintained.

EXAMPLE 2

Sample sheets having the same composition as the sheets of Example 1 were manufactured in the same manner as described in Example 1 except that the sheets each had a length and width of 12 inches (304.8 mm) and a thickness of ¼ of an inch (6.35 mm). A donut-shaped test sample was punched out of each sample sheet having an outside diameter of 2½ inches (63.50 mm) and an inside diameter of 1⅜ inches (34.93 mm). This sample was positioned between two titanium metal discs each also having an outside diameter of 2½ inches (63.50 mm) and an inside diameter of 1⅜ inches (34.93 mm). The discs were clamped together with the sample being compressed about 25 percent to a thickness of about 3/16 of an inch (4.76 mm) to simulate the compression the non-conductive sheet undergoes in actual service in a diaphragm type cell. The above assembly was immersed in the brine solution of a commercial electrolytic cell of the diaphragm type having a cell base construction as described in U.S. Pat. No. 3,591,483. The cell was operated under general conditions of the type described in the example provided in Column 8 of this patent. After several months of immersion in the brine solution of the cell, the samples have had no reported defects.

EXAMPLE 3

In order to test resistance to compression set under heat treatment conditions, samples of vulcanized elastomeric sheets of Compositions A and B in Examples 1 and 2 were tested in accordance with ASTM D-395, Method B. In one case each sample was made by plying up two ¼ of an inch (6.35 mm) thick test specimens to a total thickness of ½ of an inch (12.70 mm) in accordance with the established test procedure. In another case each sample was an unplied up test specimen having a thickness of ¼ of an inch (6.35 mm).

Samples of Compositions A and B were tested along with a sample of a commercial grade sheet of a basically neoprene rubber composition (70% neoprene rubber/30% styrene butadiene rubber) of a type previously used in electrolytic cells of the diaphragm type. This neoprene sheet is labeled as Composition C. In addition a high quality composition consisting of neoprene rubber (100%) also of a type recommended for use in electrolytic cells was also tested and is labeled Composition D. The results of the tests are listed below in Table I.

TABLE I

| Average Compression Set (%) Time at 250° F (121° C) (ASTM-D395) Method B | | | | | |
|---|---|---|---|---|---|
| Composition | | 70 hrs | 7 days | 14 days | 28 days |
| A* | ¼" | 38.23 | 54.58 | 67.75 | 77.05 |
| | ½" | 33.03 | 46.37 | 61.53 | 77.51 |
| B** | ¼" | 25.75 | 35.13 | 47.85 | 58.68 |
| | ½" | 20.00 | 27.43 | 37.27 | 50.10 |
| C | ¼" | 91.25 | 93.75 | 97.50 | 106.20 |
| | ½" | 76.00 | 79.80 | 84.30 | 94.65 |
| D | ¼" | 36.95 | 46.55 | 56.35 | 83.00 |
| | ½" | 29.20 | 35.95 | 48.50 | 88.25 |

*Average of two samples
**Average of three samples
The data from Table I indicate that Compositions A and B of the present invention retain a greater resistance to compression set under heat treatment conditions that do Compositions C and D composed of compounded neoprene rubber. Composition B which comprises an ethylene propylene terpolymer rubber (EPDM) formulation vulcanized using a peroxide type vulcanizing agent shows superior resistance to compression set over the entire range of test periods from 70 hours up to 28 days. Composition A which comprises an ethylene propylene terpolymer rubber (EPDM) formulation vulcanized using sulfur donor type vulcanizing agents is superior to Composition C over the entire range of test periods and is superior to Composition D at the 28 day level.

Compositions A, B and C were also tested by an alternate method for determining compression set properties in which a ¼ of an inch (6.35 mm) test specimen or sample of each composition was positioned between two steel discs or washers having an outside diameter of 2 inches (50.80 mm) and an inside diameter of 1 1/16 inches (26.92 mm). Each sample rested on a 4 inch by 4 inch (101.6 mm by 101.6 mm) steel plate. Steel nuts and a threaded steel stud or bolt was used to compress or deflect the sample about 25 percent of its original thickness. This test simulated the arrangement shown in FIG. 3 of the drawings and is believed to be more representative of the actual conditions encountered in an electrolytic cell. The results of these tests are listed below in Table II.

TABLE II

| Average Compression Set (%) Time at 250° F (121° C) (Simulated Cell Method) | | | | |
|---|---|---|---|---|
| Composition* | 70 hours | 7 days | 14 days | 28 days |
| A | 40.1 | 57.2 | 66.4 | 76.7 |
| B | 25.9 | 38.6 | 51.7 | 65.3 |
| C | 67.6 | 74.6 | 79.0 | 84.7 |

*Average of four samples

The data from Table II indicate that Compositions A and B of the present invention have far superior composition set properties than Composition C when tested under conditions simulating an actual electrolytic cell.

EXAMPLE 4

Various compositions of the present invention were subjected to extreme heat treatment conditions to determine the effects of long exposure to heat on their sealing properties. Compositions A and B were of the same ethylene propylene rubber formulations as presented in Examples 1-3. Compositions C and D were modifications of Compositions A and B respectively. Composition E was comprised of a polymer of chlorobutyl rubber which was vulcanized using a sulfur donor type vulcanizing agent. These formulations are as follows.

| Components | Parts by Weight | | | | |
|---|---|---|---|---|---|
| | A | B | C | D | E |
| Ethylene propylene terpolymer (1) | 100.00 | — | 100.00 | — | — |
| Ethylene propylene terpolymer (2) | — | 100.00 | — | 100.00 | — |
| Chlorobutyl rubber (3) | — | — | — | — | 100.00 |
| Carbon black | 90.00 | 90.00 | 70.00 | 45.00 | 65.00 |
| Plasticizer | 50.00 | 50.00 | 30.00 | 10.00 | 10.00 |
| Zinc oxide | 5.00 | 5.00 | 5.00 | 5.00 | 5.00 |
| Magnesium oxide | — | — | — | — | 0.50 |
| Stearic acid | 1.00 | — | 1.00 | — | 1.00 |
| Zinc stearate | — | 1.00 | — | 1.00 | — |
| Antioxidant | 2.00 | 2.00 | 2.00 | 2.00 | 1.50 |
| Sulfur | 0.10 | — | 0.10 | — | — |
| 4,4" dithiodimorpholine (4) | 1.50 | — | 1.50 | — | — |
| Zinc dibutyldithiocarbamate | 4.00 | — | 4.00 | — | — |
| Zinc dimethyl dithiocarbamate | — | — | — | — | 1.50 |
| Mixture of tetramethyl and teraethyl thiuram disulfide (5) | 2.50 | — | 2.50 | — | — |
| Bis(tertiary-butyl-peroxy-isopropyl) benzene (6) | — | 6.00 | — | 2.50 | — |
| triallyl cyanurate | — | — | — | 0.50 | — |
| | 256.60 | 253.00 | 216.50 | 166.00 | 184.50 |

(1) Nordel 1470 obtained from E I duPont deNemours & Company
(2) Nordel 1070 obtained from E I duPont deNemours & Company
(3) Butyl HT obtained from Enjay
(4) Sulfasan R obtained from R T Vanderbilt, Inc.
(5) Methyl, Ethyl Tuads obtained from R T Vanderbilt, Inc.
(6) Vulcup R obtained from Hercules, Inc.

In the above compositions the plasticizer used was paraffinic oil and the carbon black was the fast extruding furnace type. The vulcanizing agents used in Compositions A, C and E were of the sulfur donor type and those in Compositions B and D were of the peroxide type.

The above formulations were expressed in proportions on the basis of parts by weight of the ethylene propylene terpolymer rubber or the chlorobutyl rubber.

Samples of Compositions A-E were tested along with a sample of a commercial grade sheet of the same composition as that of Composition C of Example 3. The neoprene sheet was labeled as Composition F. In addition a sample of a high quality heat resistant neoprene composition similar to that of Composition D of Example 3 and a sample of a heat resistant natural rubber formulation were also tested and are labeled as Compositions G and H respectively.

All these samples of Compositions A-H were tested after exposure at 250° F (121° C) for 30, 60 and 90 days. The test was conducted in accordance with the method for simulated actual electrolytic cell conditions as described in Example 3. Each sample sheet was visually observed during the intervals of the test to determine any surface defects and the results recorded in Table III below.

TABLE III

| Average Compression Set (%) Time at 250° F (121° C) (Simulated Cell Method) | | | | |
|---|---|---|---|---|
| Composition | 30 days | 60 days | 90 days | Remarks |
| A | No Cracks | No Cracks | No Cracks | Acceptable |
| B | No Cracks | No Cracks | No Cracks | Acceptable |
| C | No Cracks | No Cracks | Cracks | Moderately Acceptable |
| D | No Cracks | No Cracks | Hard Surface | Moderately Acceptable |
| E | No Cracks | No Cracks | No Cracks | Acceptable |
| F | No Cracks | Surface Cracks | Surface Cracks | Not Acceptable |
| G | No Cracks | Surface Cracks | Surface Cracks | Not Acceptable |
| H | Surface Cracks | Surface Cracks | Surface Cracks | Not Acceptable |

The data from Table III indicate that Compositions A, B and E were "acceptable" for use in electrolytic cell service showing no cracks or hard surface conditions over the full 90 day test period. Compositions C and D although not as satisfactory as Compositions A, B and E were considered to be "moderately acceptable" since no undesirable defects arose through the first 60 days of testing. Since the test condition of 90 days at 250° F (121° C) is considered unusually severe, Compositions A-E which fall within the scope of the present invention were considered acceptable for use in forming a gasket sheet for an electrolytic cell of the diaphragm type.

Compositions F and G, on the other hand which showed undesirable surface conditions after 60 days of testing and Composition H which was severely effected after only 30 days of testing were considered "not acceptable" in this regard. Compositions F, G and H do not fall within the scope of the present invention.

In the practice of the present invention, the above example can be repeated by substituting various other polymers for the ethylene propylene terpolymer rubbers and the chlorobutyl rubber with appropriate compounding changes being made. For example, the following formulations A-E will provide equivalent results to those provided in the examples.

| Components | Parts by Weight | | | | |
|---|---|---|---|---|---|
| | A | B | C | D | E |
| Ethylene propylene rubber (1) | 100.00 | — | — | — | — |
| Chlorobutyl rubber (2) | — | 100.00 | — | — | — |
| Cross-linked butyl rubber (3) | — | — | 100.00 | — | — |
| Chlorinated polyethylene (4) | — | — | — | 100.00 | — |
| Ethylene vinyl acetate copolymer (5) | — | — | — | — | 100.00 |
| Carbon black | 45.00 | 65.00 | 100.00 | 30.00 | 30.00 |
| Plasticizer | 10.00 | 10.00 | — | 10.00 | — |
| Zinc oxide | 5.00 | 5.00 | — | — | 5.00 |
| Lead oxide (litharge) | — | — | — | 5.00 | — |
| Magnesium oxide | — | .050 | — | 5.00 | 5.00 |
| Zinc stearate | 1.00 | — | — | — | 2.00 |
| Stearic acid | — | 1.00 | 0.50 | — | — |
| Antioxidant | 2.00 | 1.50 | 2.00 | 0.50 | 4.00 |
| Bis (tertiary-butylperoxy-isopropyl) benzene (6) | 2.50 | 0.70 | 1.00 | 1.50 | 2.50 |
| Triallyl cyanurate | 0.50 | — | 0.50 | — | 1.00 |
| Meta-phenylene-bis-maleimide) (7) | — | 1.50 | — | 1.00 | — |

-continued

| Components | Parts by Weight | | | | |
|---|---|---|---|---|---|
| | A | B | C | D | E |
| | 166.00 | 185.20 | 204.00 | 153.00 | 149.50 |

(1) Vistalon 405 obtained from Enjay
(2) Butyl HT obtained from Enjay
(3) Polysar XL-20 obtained from Polysar, Inc.
(4) CMO 136 containing 36% chlorine by weight obtained from Dow Chemical
(5) Santogum 1045 containing 45% vinyl acetate by weight obtained from Monsanto
(6) Vulcup R obtained from Hercules, Inc.
(7) HVA-2 obtained from E I duPont deNemours & Company Composition A is an ethylene propylene rubber formulation, Composition B is a chlorobutyl rubber formulation, Composition C is a cross-linked butyl rubber formulation, Composition D is a chlorinated polyethylene (CPE) formulation and Composition E is a formulation of an ethylene vinyl acetate copolymer rubber (EVA). All of these compositions are vulcanized using a vulcanizing agent of the peroxide type. In Compositions A, B, D and E a fast extruding furnace type carbon black is used. Mixed thermal type carbon blacks are used in Composition C. The plasticizer used in Compositions A, B and E is paraffinic oil. In Composition D an ester type plasticizer is used. The above formulations are expressed in proportions on the basis of parts by weight based on the weight of the particular polymers.

Those skilled in the art will recognize that other changes may also be made. In Composition B the chlorobutyl polymer may, for instance, be directly replaced by a polymer of bromobutyl rubber (Bromobutyl X-2 obtained from Polysar, Inc. may be used in place of chlorobutyl rubber).

It is also to be understood that various blends or combinations including two or more of the polymers used in the practice of the present invention may also be used with comparable results being achieved.

It should be apparent to those skilled in the art that the present invention provides a sealing member of improved sealability for use as a seal in an electrolytic cell or the like apparatus with the sheet providing a satisfactory seal over wide temperature variations.

Moreover, though the use of the flexible heat-resistant sheet of this invention having improved sealing properties has been illustrated in conjunction with an electrolytic chlorine cell of the diaphragm type, it should be apparent to those skilled in the art that the invention may also be used in other similar structures where similar conditions exist.

While certain representative embodiments and details have been shown for the purpose of illustrating the invention, it will be apparent to those skilled in this art that various changes and modifications may be made therein without departing from the spirit or scope of the invention.

What is claimed is:

1. In an electrolytic cell for the electrolysis of brines, said cell comprising a cell can for containing a brine solution, a rigid cell base for supporting said can, anode members disposed within said can, and a heat and chemically resistant sealing member comprised of a composition including at least one vulcanized rubbery polymer to provide a compressive seal between rigid members of said cell with said polymer being selected from the group consisting of ethylene propylene terpolymer rubber, ethylene propylene rubber, chlorinated polyethylene and ethylene vinyl acetate copolymer rubber, said sealing member subjected to heat within the cell and after long periods of exposure to this heat is of a relatively flexible, resilient rubbery nature and has a relatively high resistance to compression set to thereby retain its sealing properties, said sealing member when heat treaded at 250° F (121° C) for the following periods of time and tested in accordance with ASTM D-395, Method B, will exhibit a compression set less than about the following values:

| Heat Treatment (Time) | Compression Set (%) |
|---|---|
| 70 hours | 35 |
| 7 days | 50 |
| 14 days | 65 |
| 28 days | 80 |

2. The invention as claimed in claim 1, wherein said rigid base is comprised of conductive metal with said anode members extending through said base and said sealing member is a vulcanized rubbery sheet covering substantially the entire cell base and in compressible engagement with the anode member to provide a compressible seal between the anode member and the cell base and between the cell base and the brine solution contained in the can with the sheet subjected to the heat generated by the brine solution and by the conductive metal of the base.

3. The invention as claimed in claim 1 with the further requirement that the sealing member when a ¼ inch thick (6.35mm) test specimen thereof is compressed 25% of its original thickness and heat treated at 250° F (121° C) for the following periods of time and tested will exhibit a compression set less than about the following values:

| Heat Treatment (Time) | Compression Set (%) |
|---|---|
| 70 hours | 50 |
| 7 days | 60 |
| 14 days | 75 |
| 28 days | 85 |

4. The invention as claimed in claim 1 wherein the sealing member will remain free of cracks when a ¼ inch thich (6.35mm) test speciment is compressed 25% of its original thickness and heat treated at 250° F (121° C) for 60 days.

5. The invention as claimed in claim 1, wherein said polymer has been vulcanized using at least one vulcanizing agent selected from the group consisting of the peroxide type and the sulfur donor type.

6. The invention as claimed in claim 1, wherein said polymer is ethylene propylene terpolymer rubber which has been vulcanized using a vulcanizing agent of the sulfur donor type.

7. The invention as claimed in claim 1 wherein the polymer has been vulcanized using a vulcanizing agent of the peroxide type.

8. The invention as claimed in claim 7, wherein said polymer is ethylene propylene terpolymer rubber.

9. The invention as claimed in claim 7, wherein said polymer is ethylene propylene rubber.

10. The invention as claimed in claim 7, wherein said polymer is chlorinated polyethylene.

11. The invention as claimed in claim 7, wherein said polymer is ethylene-vinyl acetate copolymer rubber.

12. In an electrolytic cell of the diaphragm type comprising the combination of a cell can for containing a brine solution, a conductive metal cell base supporting said can, cathodes and dimensionally stable anodes disposed within the can with anodes connected to anode risers which extend through the cell base and include a flanged member spaced from the cell base, and an electrically non-conductive vulcanized elastomeric sheet covering substantially the entire cell base and in compressible engagement with the flanged member of the anode riser to provide a compressible seal between the anode and the cell base and between the cell can and the cell base, the improvement wherein said sheet is comprised of a vulcanized heat and chemically resistant rubbery composition which after long periods of exposure to heat (a) remains of a relatively flexible resilient rubbery nature and which (b) exhibits a relatively high resistance to compression set to thereby retain a compressible seal with the anode, said composition including at least one polymer selected from the group consisting of ethylene propylene terpolymer rubber, ethylene propylene rubber, chlorinated polyethylene and ethylene vinyl acetate copolymer rubber, said sheet when heat treated at 250° F (121° C) for the following periods of time and tested in accordance with ASTM D-395, Method B, will exhibit a compression set less than about the following vaues:

| Heat, Treatment (Time) | Compression Set (%) |
|---|---|
| 70 hours | 25 |
| 7 days | 35 |
| 14 days | 45 |
| 28 days | 60 |

13. The invention as claimed in claim 12 with the further requirement that the sheet when a ¼ inch thick (6.35mm) test specimen thereof is compressed 25% of its original thickness and heat aged at 250° F (121° C) for the following periods of time and tested the sheet will exhibit a maximum compression set less than about the following values:

| Heat Treatment (Time) | Compression Set (%) |
|---|---|
| 70 hours | 30 |
| 7 days | 45 |
| 14 days | 55 |
| 28 days | 75 |

14. The invention as claimed in claim 7 wherein the sheet will remain free of cracks when a ¼ inch thick (6.35mm) test specimen is compressed 25% of its original thickness and heat treated at 250° F (121° C) for 90 days.

15. The invention as claimed in claim 7 wherein said polymer has been vulcanized using a vulcanizing agent selected from the group consisting of the peroxide type and the sulfur donor type.

16. The invention as claimed in claim 12 wherein said polymer has been vulcanized using a vulcanizing agent of the peroxide type.

17. The invention as claimed in claim 12, wherein said polymer has been vulcanized using a vulcanizing agent selected from the group consisting of the peroxide type and the sulfur donor type.

18. The invention as claimed in claim 12, wherein said polymer has been vulcanized using a vulcanizing agent of the peroxide type.

* * * * *

UNITED STATES PATENT AND TRADEMARK OFFICE

CERTIFICATE OF CORRECTION

PATENT NO. : 4,098,670

DATED : July 4, 1978

INVENTOR(S) : Harry S Custer and Brian H Oliver

It is certified that error appears in the above-identified patent and that said Letters Patent are hereby corrected as shown below:

Claim 14, line 1, "7" should be -- 12 --.

Claim 15, line 1, "7" should be -- 12 --.

Claim 17, line 1, "12" should be -- 2 --.

Claim 18, line 1, "12" should be -- 2 --.

Signed and Sealed this

*Twelfth* Day of *February 1980*

[SEAL]

*Attest:*

SIDNEY A. DIAMOND

*Attesting Officer*

*Commissioner of Patents and Trademarks*